US008640658B2

(12) United States Patent
Benet

(10) Patent No.: US 8,640,658 B2
(45) Date of Patent: Feb. 4, 2014

(54) THERMAL ENGINE FOR AN AUTOMOTIVE VEHICLE COMPRISING A WATER-PUMP DEGASSING DUCT

(75) Inventor: Frederic Benet, Buc (FR)

(73) Assignee: Renault S.A.S., Boulogne Billancourt (FR)

( * ) Notice: Subject to any disclaimer, the term of this patent is extended or adjusted under 35 U.S.C. 154(b) by 645 days.

(21) Appl. No.: 12/515,699

(22) PCT Filed: Oct. 9, 2007

(86) PCT No.: PCT/FR2007/052104
§ 371 (c)(1),
(2), (4) Date: Jul. 16, 2009

(87) PCT Pub. No.: WO2008/062116
PCT Pub. Date: May 29, 2008

(65) Prior Publication Data

US 2010/0012056 A1 Jan. 21, 2010

(30) Foreign Application Priority Data

Nov. 20, 2006 (FR) ..... 06 54988

(51) Int. Cl.
*F01P 5/10* (2006.01)

(52) U.S. Cl.
USPC ..... 123/41.44; 123/41.74

(58) Field of Classification Search
USPC ..... 123/41.44, 41.74, 41.01, 41.17, 41.72
See application file for complete search history.

(56) References Cited

U.S. PATENT DOCUMENTS

| | | | | | |
|---|---|---|---|---|---|
| 2,681,054 | A * | 6/1954 | Boghossian | 123/195 R |
| 2,816,533 | A * | 12/1957 | Reggio | 123/90.13 |
| 4,394,850 | A * | 7/1983 | Hayashi | 123/41.74 |
| 4,412,515 | A * | 11/1983 | Fritzenwenger | 123/198 E |
| 4,570,579 | A * | 2/1986 | Hirano | 123/41.02 |
| 4,777,912 | A * | 10/1988 | Fischer et al. | 123/41.79 |
| 5,111,774 | A * | 5/1992 | Hiramoto et al. | 123/41.1 |
| 5,337,704 | A * | 8/1994 | Roth | 123/41.1 |
| 5,970,928 | A | 10/1999 | Smietanski et al. | |
| 6,446,682 | B1 * | 9/2002 | Viken | 141/59 |
| 6,530,356 | B2 * | 3/2003 | Inoue et al. | 123/196 R |
| 6,843,209 | B2 * | 1/2005 | Miyagawa et al. | 123/41.1 |
| 6,978,742 | B2 * | 12/2005 | Miyagawa et al. | 123/41.1 |
| 2002/0062795 | A1 * | 5/2002 | Inoue et al. | 123/41.1 |
| 2006/0005791 | A1 * | 1/2006 | Obidi | 123/41.29 |

FOREIGN PATENT DOCUMENTS

| | | |
|---|---|---|
| EP | 1 505 275 | 2/2005 |
| FR | 2 594 184 | 8/1987 |
| FR | 2 736 385 | 1/1997 |

* cited by examiner

*Primary Examiner* — Noah Kamen
*Assistant Examiner* — Long T Tran
(74) *Attorney, Agent, or Firm* — Oblon, Spivak, McClelland, Maier & Neustadt, L.L.P.

(57) ABSTRACT

A thermal engine for an automotive vehicle, including at least one cylinder block including a first inner circuit for circulating a cooling liquid, of the type in which the first inner circuit includes an outer supply duct including an inlet opening into a reception chamber for a rotor of the engine water pump formed in the block. The chamber includes in its intermediate portion a supply opening having a level located above the level of the inlet opening of the inner supply duct of the first inner circuit. An additional degassing duct connects the upper portion of the reception chamber or water pump volute with an element of the engine cooling circuit.

12 Claims, 2 Drawing Sheets

THERMAL ENGINE FOR AN AUTOMOTIVE VEHICLE COMPRISING A WATER-PUMP DEGASSING DUCT

BACKGROUND OF THE INVENTION

The invention relates to a heat engine for a motor vehicle.

The invention relates more particularly to a heat engine for a motor vehicle, of the type which comprises at least one cylinder block which comprises a first internal circuit for the circulation of a cooling liquid, of the type in which the first internal circuit comprises an internal supply duct an inlet orifice of which opens into a reception chamber or "volute", that is substantially cylindrical, of a rotor belonging to a water pump of the engine, which is formed in the block, said chamber comprising in an intermediate portion a supply orifice the level of which is arranged above the level of the inlet orifice of the internal supply duct of the first internal circuit.

Many examples of heat engines of this type are known.

A known disadvantage of this type of engine is associated with the particular arrangement of the orifice for supplying the reception chamber or "volute" of the water pump with respect to the inlet orifice of the first circuit.

Specifically, in this configuration, when it is desired to fill the cooling circuit by gravity, an air pocket forms in the upper portion of the reception chamber or volute which is situated above the level of the orifice for supplying said reception chamber.

This residual air pocket prevents the priming of the water pump when the engine is started, which may result in damage to the water pump or a lack of the circulation of the cooling liquid within the cooling circuit of the vehicle.

It is therefore necessary to fill the cooling circuit under pressure in order to achieve a correct priming of the water pump.

SUMMARY OF THE INVENTION

To remedy this disadvantage, the invention proposes an engine of the type described above comprising means for draining the upper portion of the reception chamber or volute of the water pump.

For this purpose, the invention proposes a heat engine of the type described above, characterized in that it comprises an additional venting duct which connects an upper portion of the reception chamber or volute of the water pump to an element of the cooling circuit of the engine in order to allow the reception chamber to be completely filled by gravity when the first internal circuit is filled.

According to other features of the invention:

- the determined element is a chamber which is formed in the cylinder block and which forms part of the first internal circuit,
- the additional duct is a calibrated duct formed in the cylinder block,
- the cylinder block is capped by a cylinder head, a second internal circuit for the circulation of a cooling liquid communicating with the first internal circuit via at least one drill hole formed in a cylinder head gasket, and the determined element is said drill hole in the cylinder head gasket,
- the additional duct is formed in the cylinder block and opens into the drill hole in the cylinder head gasket,
- the additional duct is cast in one piece with the cylinder block and is calibrated by the cylinder head gasket,
- the additional duct is a calibrated drill hole made in the cylinder block,

- the determined element is an external duct for supplying an engine member, notably an oil cooler, with cooling liquid, said external duct being placed beside the block,
- the additional duct is formed in the cylinder block and opens into the external duct via a hole.

BRIEF DESCRIPTION OF THE DRAWINGS

Other features and advantages of the invention will appear on reading the following detailed description for the understanding of which reference will be made to the appended drawings in which.

DETAILED DESCRIPTION OF THE INVENTION

In the following description, identical reference numbers designate parts that are identical or have similar functions.

Figure 1:
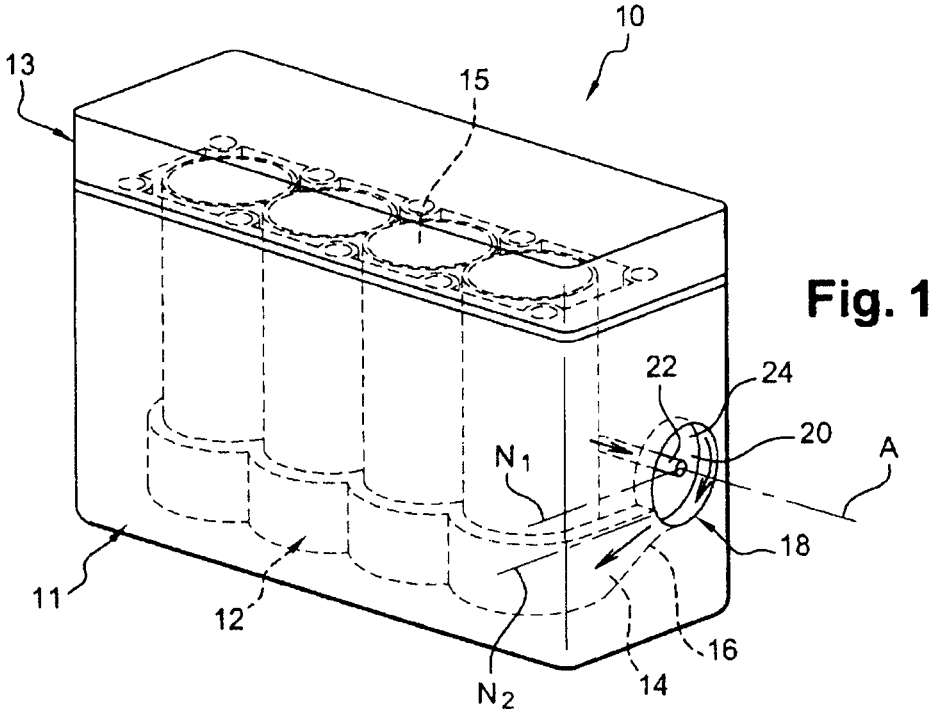
FIG. 1 is a schematic view in perspective of an engine block according to a prior art.

FIG. 1 depicts a motor vehicle engine 10 comprising a block 11, commonly called a "cylinder block", capped by a cylinder head 13.

In a known manner, the cylinder block 11 comprises a first internal circuit 12 for the circulation of a cooling liquid which is designed for example to cool the engine block 11 by allowing circulation of a cooling liquid around the cylinders 15 of the engine.

In a known manner, the first internal circuit 12 comprises an internal supply duct 14, an inlet orifice 16 of which opens into a reception chamber 18, also called a "volute", which is arranged in the block 11 and which is designed to receive a rotor (not shown) of a water pump fitted to the engine 10.

In a known manner, the reception chamber 18 is formed in the cylinder block 11 and it comprises, in an intermediate portion 20, arranged for example substantially level with the axis "A" of rotation of the rotor (not shown), a supply orifice 22 designed to allow the water pump of the engine to be supplied with cooling liquid.

As can be seen in FIG. 1, in a known manner, the level $N_1$ of the orifice 22 for supplying the reception chamber 18 is arranged above the level $N_2$ of the inlet orifice 16 of the internal supply duct 14 of the first internal circuit 12.

A known disadvantage of heat engines 10 made in this design is associated precisely with the difference between the level $N_1$ of the supply orifice 22 and the level $N_2$ of the inlet orifice 16 of the first internal circuit 12.

Specifically, when it is desired to fill such a cooling circuit by gravity, because of the difference between the levels $N_1$ and $N_2$, an air pocket forms in the upper portion 24 of the reception chamber 18 which is arranged above the supply orifice 22 of the reception chamber 18.

This residual air pocket prevents the priming of the water pump when the engine is started, which may result in damage to the water pump or a lack of circulation of the cooling liquid within the cooling circuit of the vehicle.

It is therefore necessary to fill the cooling circuit under pressure in order to achieve a correct priming of the water pump, and a draining of the circuit at another point, which complicates the operation to fill the circuit.

To remedy this disadvantage, the invention proposes an engine 10 of the type described above, comprising means for draining the upper portion 24 of the reception chamber 18 of the water pump.

For this purpose, the invention proposes a heat engine 10 of the type described above, characterized in that it comprises an additional venting duct 26 which connects the upper portion 24 of the reception chamber 18 of the water pump to an element of the cooling circuit of the engine in order to allow the reception chamber 18 to be completely filled by gravity when the first internal circuit 12 is filled.

Figure 2:
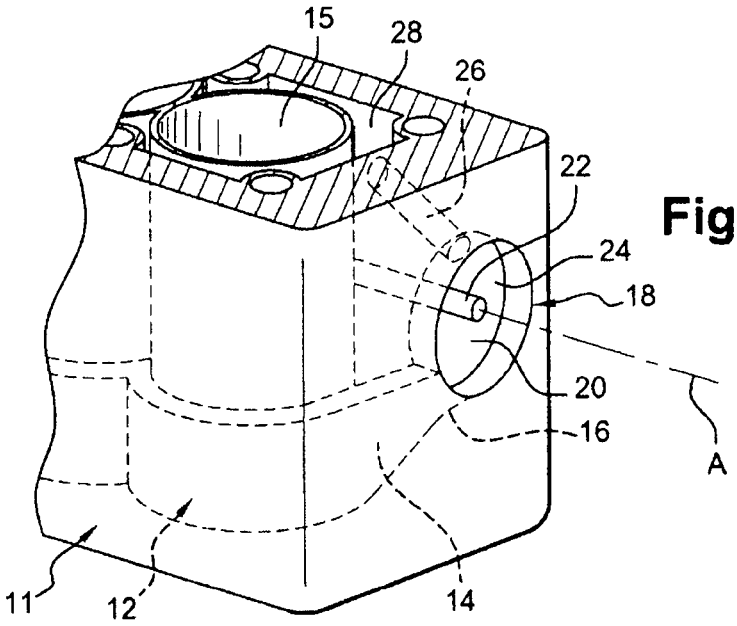
FIG. 2 is a detailed schematic view in perspective of an engine block according to a first embodiment of the invention.

According to a first embodiment of the invention, which has been shown in FIG. 2, the determined element to which the additional duct 26 is connected is a chamber 28 which is formed in the cylinder block 11 and which forms part of the first internal circuit 12. This chamber 28 is for example a peripheral chamber surrounding a cylinder 15 of the cylinder block 11.

In this embodiment, the additional duct 26 is preferably a duct 26 formed in the cylinder block 11, and this duct 26 is calibrated so as to allow a leakage of cooling liquid from the reception chamber 18 of the water pump which is sufficient to allow the air pocket to be dispelled, and which is nevertheless small enough not to hamper the operation of the water pump.

Figure 3:
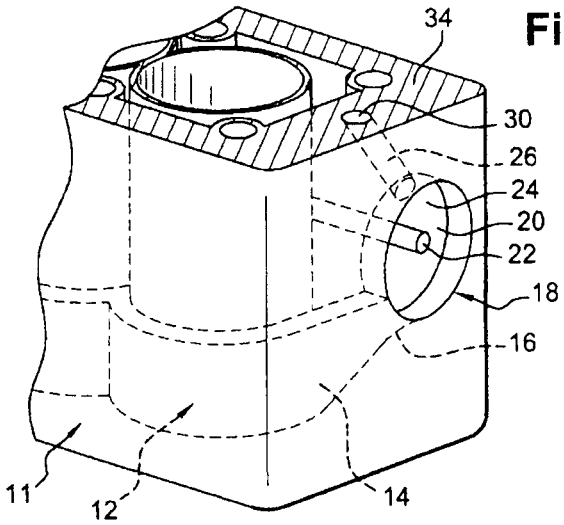
FIG. 3 is a detailed schematic view in perspective of an engine block according to a second embodiment of the invention.
Figure 4:
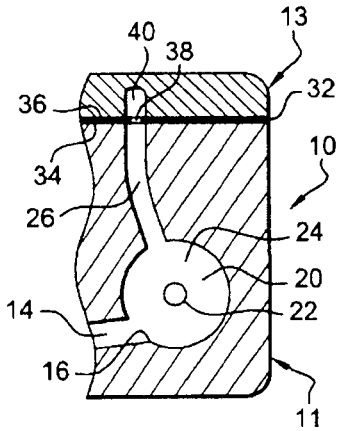
FIG. 4 is a schematic view in section of the engine according to the second embodiment of the invention.

According to a second embodiment of the invention which has been shown in the detailed views of FIG. 3 and of FIG. 4, the invention advantageously takes advantage of the presence of a cylinder head 13 of the engine which caps the cylinder block 11.

A cylinder head gasket 32 is arranged between an upper face 34 of the cylinder block 11 and a lower face 36 of the cylinder head 13.

As illustrated in FIG. 4, the cylinder head gasket 32 comprises at least one drill hole 38 which allows the first internal circuit 12 of the block 11 to communicate with a second internal circuit 40 of the cylinder head 30.

In this configuration, the determined element to which the additional venting duct 26 is connected is the drill hole 38 in the cylinder head gasket 32.

For example, the additional venting duct 26 is formed in the cylinder block 11 and it opens into the upper face 34 of the block 11 via an orifice 30 which is designed to substantially coincide with the drill hole 38 of the cylinder head gasket 32.

In a manner similar to the preceding embodiment, as illustrated in FIG. 4, the additional duct 26 may advantageously be calibrated by the cylinder head gasket 32 itself, the latter being able to obstruct to a greater or lesser degree the end of the additional duct 26 formed by the orifice 30 so as to regulate the flow rate of cooling liquid circulating in said additional duct 26, in order to allow sufficient venting of the air pocket contained in the reception chamber 18 without however hampering the operation of the water pump.

Advantageously, it will be understood that in this embodiment, the additional duct 26 will preferably be cast in one piece with the cylinder block 11, which makes it possible to achieve its calibration only via the cylinder head gasket 32 without requiring particular machining of said duct 26.

It will also be understood that, as a variant, the additional duct 26 may, in a manner similar to the first embodiment of the invention, be a calibrated duct which opens fully into the drill hole 38 of the cylinder head gasket, the calibration of the additional duct 26 then resulting from a machining of said duct 26, and notably of its end orifice 30, in the cylinder block 11.

Figure 5:
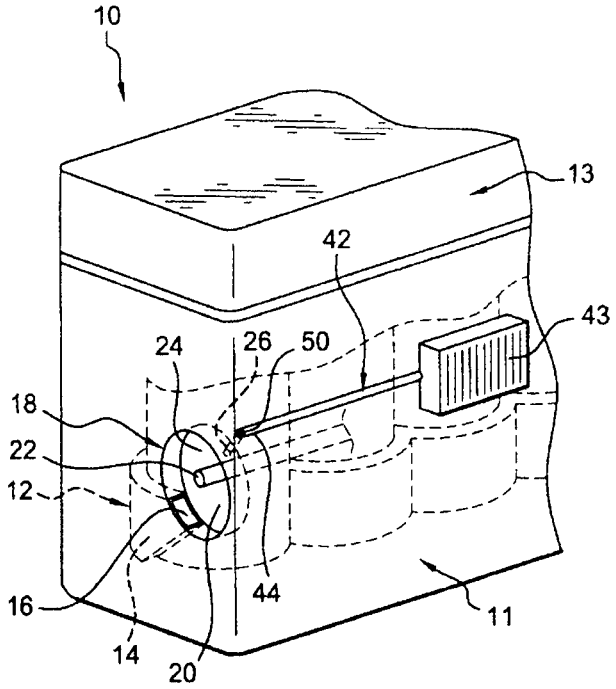
FIG. 5 is a schematic view in perspective of an engine block according to a third embodiment of the invention.

Finally, according to a third embodiment of the invention which has been shown in FIG. 5, the determined element to which the additional venting duct 26 is connected may be an external duct 42 for supplying an engine member, for example an oil cooler 43, with cooling liquid, said external supply duct 42 being placed beside the cylinder block 11.

In this configuration, at least a communication portion 44 of the external duct 42 comprises a wall independent of the cylinder block and a wall forming part of the cylinder block 11, which communicates with the additional duct 26 via a hole 50. This design advantageously makes it possible to dispense with a connection of the additional duct 26 with the communication portion 44 of the external duct 42, while ensuring a perfect seal.

The external duct 42 is then delimited in its communication portion 44 by its independent wall and by its wall formed on the outside of the cylinder block 11.

The invention therefore advantageously makes it possible to achieve venting of the reception chamber 18 of a water pump belonging to a motor vehicle engine 10, which makes it possible to fill the cooling circuit by gravity without needing to pressurize said cooling circuit.

The maintenance of such a motor vehicle engine 10 is therefore made much easier.

The invention claimed is:

1. A heat engine for a motor vehicle, comprising:

at least one cylinder block that includes a first internal circuit for circulation of a cooling liquid, in which the first internal circuit includes an internal supply duct, and an inlet orifice of the internal supply duct opens into a reception chamber, that is substantially cylindrical, configured to house a rotor belonging to a water pump of the engine, and is formed in the at least one cylinder block, the reception chamber including in an intermediate portion a supply orifice at a level arranged above a level of the inlet orifice of the internal supply duct of the first internal circuit; and an additional venting duct, formed in the cylinder block, that connects an upper portion of the reception chamber of the water pump to an element of a cooling circuit of the engine to allow the reception chamber to be completely filled by gravity when the first internal circuit is filled.

2. The heat engine as claimed in claim 1, wherein the reception chamber is formed in the cylinder block and forms part of the first internal circuit.

3. The heat engine as claimed in claim 2, wherein the additional venting duct is a calibrated duct.

4. The heat engine as claimed in claim 1, wherein the cylinder block is capped by a cylinder head, a second internal circuit for the circulation of a cooling liquid communicating with the first internal circuit via at least one drill hole is formed in a cylinder head gasket, and the element is the drill hole in the cylinder head gasket.

5. The heat engine as claimed in claim 4, wherein the additional venting duct opens into the drill hole in the cylinder head gasket.

6. The heat engine as claimed in claim 5, wherein the additional venting duct is cast in one piece with the cylinder block and is calibrated by the cylinder head gasket.

7. The heat engine as claimed in claim 5, wherein the additional venting duct is a calibrated drill hole made in the cylinder block.

8. The heat engine as claimed in claim 1, wherein the element is an external duct for supplying an engine member, or supplying an oil cooler, with cooling liquid, the external duct being placed beside the block.

9. The heat engine as claimed in claim 8, wherein the additional venting duct is formed in the cylinder block and opens into the external duct via a hole.

10. The heat engine as claimed in claim 1, wherein the element of the cooling circuit is a peripheral chamber that surrounds a cylinder of the cylinder block.

11. The heat engine as claimed in claim 1, wherein the additional venting duct is cast in one piece with the cylinder block.

12. The heat engine as claimed in claim 1, wherein the additional venting duct extends between the upper portion of the reception chamber and the element of the cooling circuit.

* * * * *